US006641462B2

(12) United States Patent
Eaton

(10) Patent No.: US 6,641,462 B2
(45) Date of Patent: Nov. 4, 2003

(54) METHOD AND APPARATUS FOR DISTRIBUTING FLUID TO A POLISHING SURFACE DURING CHEMICAL MECHANICAL POLISHING

(75) Inventor: Robert A. Eaton, Scottsdale, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 109 days.

(21) Appl. No.: 09/893,131

(22) Filed: Jun. 27, 2001

(65) Prior Publication Data

US 2003/0003850 A1 Jan. 2, 2003

(51) Int. Cl.[7] ..... B24B 19/22

(52) U.S. Cl. ..... 451/41; 451/57; 451/60; 451/285

(58) Field of Search ..... 451/57, 60, 41, 451/259, 285, 287–289, 264, 265, 268, 269, 270, 272, 273, 392, 393, 394, 397, 400

(56) References Cited

U.S. PATENT DOCUMENTS

| | | | | |
|---|---|---|---|---|
| 5,232,875 A | | 8/1993 | Tuttle et al. | |
| 5,554,064 A | | 9/1996 | Breivogel et al. | |
| 5,605,488 A | * | 2/1997 | Ohashi et al. | 451/7 |
| 5,876,271 A | * | 3/1999 | Oliver | 451/60 |
| 5,893,795 A | * | 4/1999 | Perlov et al. | 451/288 |
| 5,921,849 A | | 7/1999 | Kim et al. | |
| 5,989,107 A | * | 11/1999 | Shimizu et al. | 451/57 |
| 6,048,259 A | * | 4/2000 | Asai | 451/339 |
| 6,050,884 A | * | 4/2000 | Togawa et al. | 451/67 |
| 6,095,904 A | | 8/2000 | Breivogel et al. | |

FOREIGN PATENT DOCUMENTS

| | | |
|---|---|---|
| EP | 0 774 323 A2 | 5/1997 |
| EP | 0 842 738 A2 | 5/1998 |

* cited by examiner

*Primary Examiner*—Joseph J. Hail, III
*Assistant Examiner*—Anthony Ojini
(74) *Attorney, Agent, or Firm*—Ingrassia Fisher & Lorenz

(57) ABSTRACT

A fluid delivery system is provided for delivering a fluid to a polishing surface of a chemical mechanical polishing tool. The system includes a platen, manifold and slurry delivery conduit. The platen has a plurality of conduits for allowing a fluid to pass to the polishing surface. The manifold, through the use of a plurality of channels, controls the fluid distribution to the conduits in the platen. The channel cross-sectional area at substantially every point is greater than, preferably 1.5 to 2 times, the combined cross-sectional area of all the conduits being serviced by the channel. This results in the conduits being the most restrictive feature and a uniform pressure within the manifold. However, the volume of the channels should also be reduced as this reduces the time necessary for a fluid change over. The slurry delivery conduit communicates fluid from a fluid source to the channels in the manifold.

16 Claims, 12 Drawing Sheets

METHOD AND APPARATUS FOR DISTRIBUTING FLUID TO A POLISHING SURFACE DURING CHEMICAL MECHANICAL POLISHING

FIELD OF THE INVENTION

The present invention generally relates to polishing a surface of a workpiece. More particularly, the invention relates to improved methods and apparatus for distributing fluids, for example slurry, to the surface of a polishing pad during chemical mechanical polishing.

BACKGROUND OF THE INVENTION

Chemical mechanical polishing or planarizing a surface of an object may be desirable for several reasons. For example, chemical mechanical polishing is often used in the formation of microelectronic devices to provide a substantially smooth, planar surface suitable for subsequent fabrication processes such as photoresist coating and pattern definition. Chemical mechanical polishing may also be used to form microelectronic features. For example, a conductive feature such as a metal line or a conductive plug may be formed on a surface of a wafer by forming trenches and vias on the wafer surface, depositing conductive material over the wafer surface and into the trenches and vias, and removing the conductive material on the surface of the wafer using chemical mechanical polishing, leaving the vias and trenches filled with the conductive material.

A typical chemical mechanical polishing apparatus suitable for planarizing the semiconductor surface generally includes a wafer carrier configured to support, guide, and apply pressure to a wafer during the polishing process; a polishing compound such as a slurry containing abrasive particles and chemicals to assist removal of material from the surface of the wafer; and a polishing surface such as a polishing pad. In addition, the polishing apparatus may include an integrated wafer cleaning system and/or an automated load and unload station to facilitate automatic processing of the wafers.

A wafer surface is generally polished by moving the surface of the wafer to be polished relative to the polishing surface in the presence of the polishing compound. In particular, the wafer is placed in the carrier such that the surface to be polished is placed in contact with the polishing surface and the polishing surface and the wafer are moved relative to each other while slurry is supplied to the polishing surface.

The distribution of slurry over the polishing surface has been shown to be a critical factor in the chemical mechanical polishing process. The material removal rate across the surface of the wafer is generally related to the amount of slurry received by the polishing surface. Areas on the polishing surface having additional slurry will typically polish the wafer faster than areas on the polishing surface having less slurry. While the material removal rate may be fine tuned by intentionally adjusting the slurry distribution across the polishing surface, it is desirable to have a substantially uniform slurry distribution across the polishing surface.

One approach to distributing slurry across a polishing surface involves depositing the slurry from above in the middle of the polishing surface. Polishing surfaces typically move, for example, in a rotational, orbital or linear motion. The motion, in addition to removing material from the front surface of the wafer, helps to distribute the slurry across the polishing surface. However, this approach leads to a concentration of slurry in the middle of the polishing surface with the concentration of slurry declining in relation to its distance from the middle of the polishing surface.

Another approach to distributing slurry across a polishing surface involves pumping slurry from a cavity below the polishing surface through apertures in a platen and polishing surface to the polishing surface. However, the motions previously mentioned cause the slurry to concentrate along the periphery of the cavity and therefore, when forced to the polishing surface, the slurry is concentrated along the periphery of the polishing surface. As a partial correction for this problem, a cut o-ring has been spirally inserted into the cavity to reduce the concentration of slurry at the periphery of the polishing pad. However, the optimum shape of the cut spiral o-ring is difficult to determine and the optimum shape changes with different slurry delivery rates, speed of motions and types of slurry.

Another problem with using the cavity to distribute the slurry is the time it takes to change from a first slurry reaching the surface of the polishing pad to a second slurry reaching the surface of the polishing pad. Applicant has noticed the delay is caused by the cavity having a volume filled with the first slurry that must be completely replaced by the second slurry. The Applicant has also noticed the problem is compounded by parts of the cavity having no real flow direction resulting in a turbulent fluid motion. The turbulent fluid motion results in a mixing of the slurry and an additional time period when both slurries are delivered to the polishing surface further lengthening the time for a complete slurry change over.

What is needed is a method and apparatus for uniformly delivering a fluid to a polishing surface without being unduly affected by slurry delivery rates, speed of motions or types of slurry. The method and apparatus preferably allow a change in slurry to be quickly accomplished.

SUMMARY OF THE INVENTION

The present invention provides improved methods and apparatus for chemical mechanical polishing of a surface of a workpiece that overcome many of the shortcomings of the prior art. While the ways in which the present invention addresses the drawbacks of the now-known techniques for chemical mechanical polishing will be described in greater detail hereinbelow, in general, in accordance with various aspects of the present invention, the invention provides an improved method and apparatus for controlling the distribution of a fluid across a polishing surface.

The invention is a fluid delivery system for delivering a fluid to a polishing surface for a chemical mechanical polishing tool. The invention includes a platen, manifold and slurry delivery conduit. The platen supports the polishing surface and has a plurality of conduits for allowing a fluid to pass through the conduits in the platen and, preferably, through corresponding conduits in the polishing surface. This allows the fluid to reach the working area of the polishing surface. The platen may comprise several layers for performing additional functions not directly related to fluid distribution to the polishing surface.

The manifold controls the fluid distribution to the conduits to allow the fluid to pass through the platen and polishing pad. The manifold uses a plurality of channels in controlling the fluid distribution to the conduits of the platen. The channels may be formed in the manifold in a variety of ways, including, for example, by removing material from a monolithic manifold by machining or etching.

In one embodiment of the invention, the volume of all the channels is less than a third of the volume of the whole manifold. Reducing the volume of the channels reduces the time for a fluid change over. In another embodiment of the invention the channel cross-sectional area at substantially every point in the channels is greater than, preferably between by 1.5 and 2 times, the combined cross-sectional area of all the conduits being serviced by the channel. This causes the conduits in the platen to be the most restrictive feature in the fluid flow path resulting in a uniform back-pressure in the manifold and therefore resulting in a uniform velocity of fluid flow. The cross-section of the channels may be incrementally changed or smoothly tapered.

The slurry delivery conduit communicates fluid from a fluid source to the channels in the manifold. The slurry delivery conduit is preferably in fluid communication with a central area of the manifold that feeds the plurality of channels. The slurry delivery conduit may be in fluid communication with a plurality of fluid sources so that a plurality of different fluids, preferably one at a time, may be communicated to the channels in the manifold as desired.

In operation, a fluid may be distributed across a polishing surface by pumping a fluid from a fluid source to a central area connected to a plurality of channels in a manifold. The fluid is communicated through the plurality of channels in the manifold to a plurality of conduits in a platen. Incrementally changing or tapering the channels as previously described results in a substantially uniform velocity of the fluid throughout the channels. The fluid travels through the conduits in the platen and through the polishing surface, preferably through corresponding conduits in the polishing surface, to reach a working area of the polishing surface.

BRIEF DESCRIPTION OF THE DRAWINGS

A more complete understanding of the present invention may be derived by referring to the detailed description and claims, considered in connection with the figures, wherein like reference numbers refer to similar elements throughout the figures, and:

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EXEMPLARY EMBODIMENTS

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
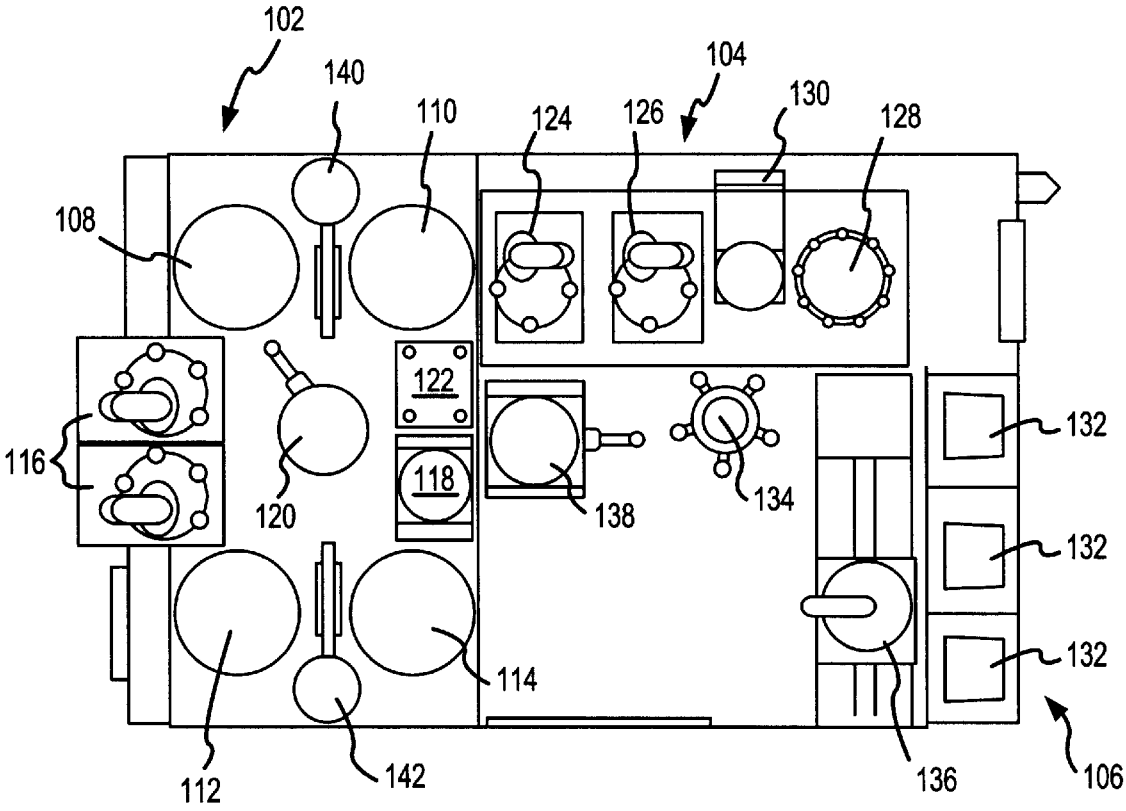
FIG. 1 illustrates a top cut-away view of a polishing system in accordance with the present invention.

FIG. 1 illustrates a top cut-way view of a polishing apparatus 100, suitable for removing material from a surface of a workpiece, in accordance with the present invention. Apparatus 100 includes a multi-platen polishing system 102, a clean system 104, and a wafer load and unload station 106. In addition, apparatus 100 includes a cover (not illustrated) that surrounds apparatus 100 to isolate apparatus 100 from the surrounding environment. In accordance with a preferred embodiment of the present invention machine 100 is a Momentum machine available from SpeedFam-IPEC Corporation of Chandler, Ariz. However, machine 100 may be any machine capable of removing material from a workpiece surface.

Although the present invention may be used to remove material from a surface of a variety of workpieces such as magnetic discs, optical discs, and the like, the invention is conveniently described below in connection with removing material from a surface of a wafer. In the context of the present invention, the term "wafer" shall mean semiconductor substrates, which may include layers of insulating, semiconducting, and conducting layers or features formed thereon, used to manufacture microelectronic devices.

Exemplary polishing system 102 includes four polishing stations 108, 110, 112, and 114, which each operate independently; a buff station 116; a transition stage 118; a robot 120; and optionally, a metrology station 122. Polishing stations 108–114 may be configured as desired to perform specific functions; however, in accordance with the present invention, at least one of stations 108–114 includes an orbital polish station as described herein. The remaining polishing stations may be configured for chemical mechanical polishing, electrochemical polishing, electrochemical deposition, or the like.

Polishing system 102 also includes polishing surface conditioners 140, 142. The configuration of conditioners 140, 142 generally depends on the type of polishing surface to be conditioned. For example, when the polishing surface comprises a polyurethane polishing pad, conditioners 140, 142 suitably include a rigid substrate coated with diamond material. Various other surface conditioners may also be used in accordance with the present invention.

Clean system 104 is generally configured to remove debris such as slurry residue and material removed from the wafer surface during polishing. In accordance with the illustrated embodiment, system 104 includes clean stations 124 and 126, a spin rinse dryer 128, and a robot 130 configured to transport the wafer between clean stations 124, 126 and spin rinse dryer 128. In accordance with one aspect of this embodiment, each clean station 124 and 126 includes two concentric circular brushes, which contact the top and bottom surfaces of a wafer during a clean process.

Figure 2:
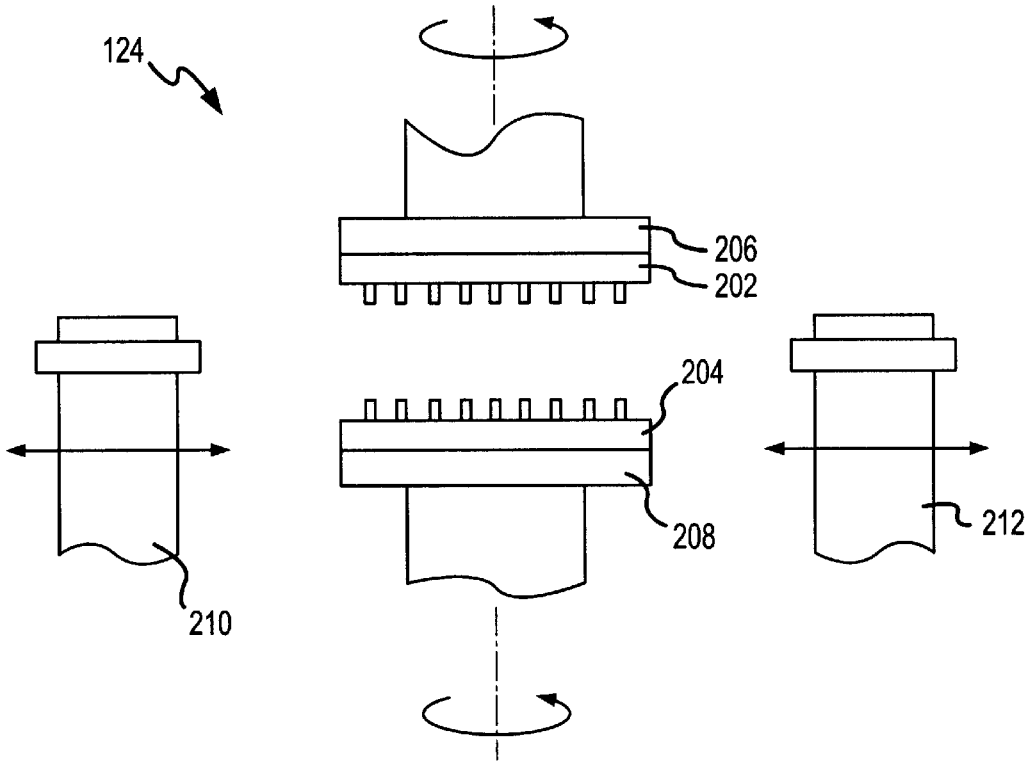
FIG. 2 illustrates a side view of a portion of a clean system for use with the apparatus of FIG. 1.

FIG. 2 illustrates an exemplary clean station (e.g., station 124) in greater detail. Clean station 124 includes brushes 202, 204 mounted to brush platens 206, 208. Station 124 also includes movable rollers—e.g., capstan rollers 210, 212—to keep the wafer in place during the clean process.

In accordance with one embodiment of the invention, during the clean operation, a wafer is placed onto the capstan rollers, and lower clean platen 208 and brush 204 rise to contact and apply pressure to a lower surface of the wafer, while upper platen 206 and brush 202 lower to contact the upper surface of the wafer The brushes are then caused to rotate about their axes to scour the surfaces of the wafer in the presence of a cleaning fluid such as deionized water and/or a $NH_4OH$ solution.

Wafer load and unload station 106 is configured to receive dry wafers for processing in cassettes 132. In accordance with the present invention, the wafers are dry when loaded onto station 106 and are dry before return to station 106.

In accordance with an alternate embodiment of the invention, clean system 104 may be separate from the polishing apparatus. In this case, load station 106 is configured to receive dry wafers for processing, and the wafers are held in a wet (e.g., deionized water) environment until the wafers are transferred to the clean station.

In operation, cassettes 132, including one or more wafers, are loaded onto apparatus 100 at station 106. A wafer from one of cassettes 132 is transported to a stage 134 using a dry robot 136. A wet robot 138 retrieves the wafer at stage 134 and transports the wafer to metrology station 122 for film characterization or to stage 118 within polishing system 102. In this context, a "wet robot" means automation equipment configured to transport wafers that have been exposed to a liquid or that may have liquid remaining on the wafer and a "dry robot" means automation equipment configured to transport wafers that are substantially dry. Robot 120 picks up the wafer from metrology station 122 or stage 118 and transports the wafer to one of polishing stations 108–114 for chemical mechanical polishing.

After polishing, the wafer is transferred to buff station 116 to further polish the surface of the wafer. The wafer is then transferred (optionally to metrology station 122 and) to stage 118, which keeps the wafers in a wet environment, for pickup by robot 138. Once the wafer is removed from the polishing surface, conditioners 140,142 may be employed to condition the polishing surface. Conditioners 140, 142 may also be employed prior to polishing a wafer to prepare the surface for wafer polishing.

After a wafer is placed in stage 118, robot 138 picks up the wafer and transports the wafer to clean system 104. In particular, robot 138 transports the wafer to robot 130, which in turn places the wafer in one of clean stations 124, 126. The wafer is cleaned using one or more stations 124, 126 and is then transported to spin rinse dryer 128 to rinse and dry the wafer prior to transporting the wafer to load and unload station 106 using robot 136.

Figure 3:
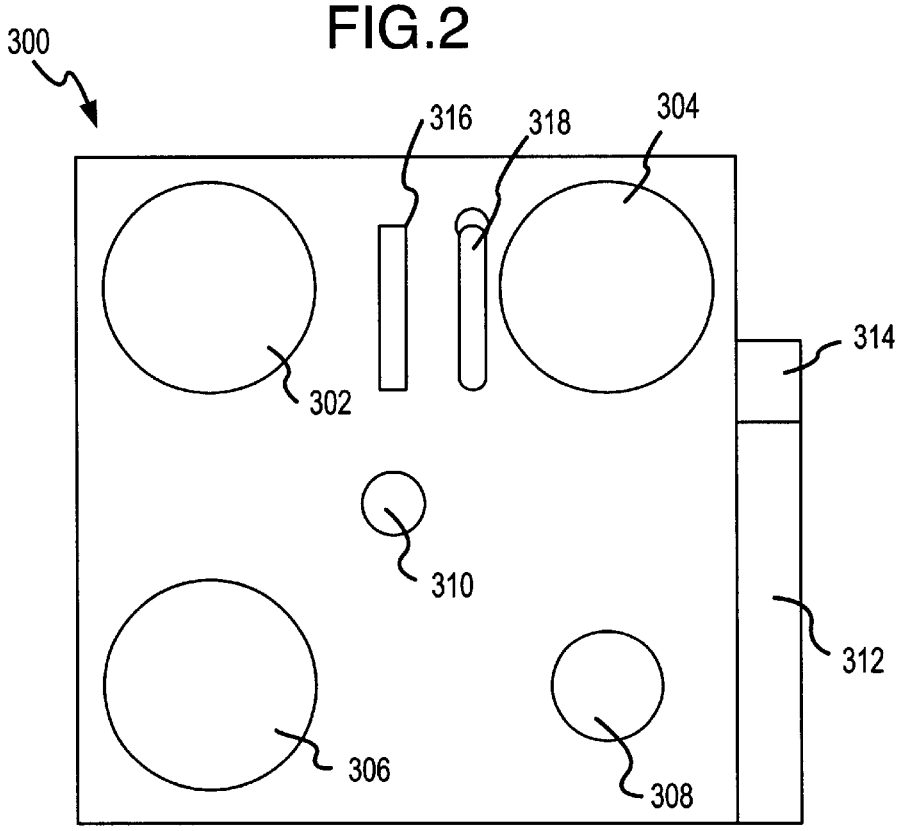
FIG. 3 illustrates a top cut-away view of a polishing system in accordance with another embodiment of the invention.
Figure 4:
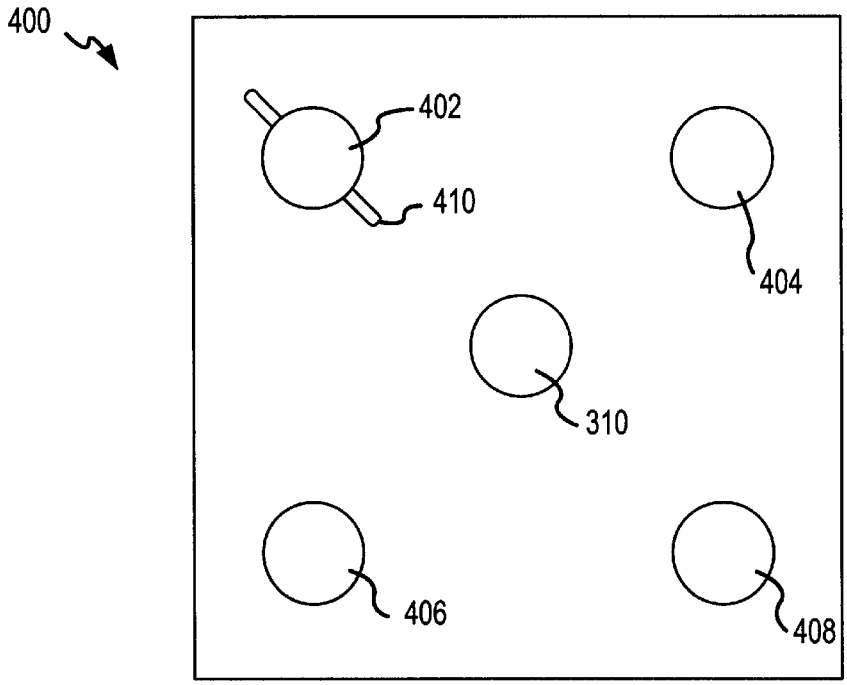
FIG. 4 illustrates a bottom view of a carrier carousel for use with the apparatus illustrated in FIG. 3.

FIG. 3 illustrates a top cut-away view of another exemplary polishing apparatus 300, configured to remove material from a wafer surface. Apparatus 300 is suitably coupled to carousel 400, illustrated in FIG. 4, to form an automated chemical mechanical polishing system. A chemical mechanical polishing system in accordance with this embodiment may also include a removable cover (not illustrated in the figures) overlying apparatus 300 and 400.

Apparatus 300 includes three polishing stations 302, 304, and 306, a wafer transfer station 308, a center rotational post 310, which is coupled to carousel 400, and which operatively engages carousel 400 to cause carousel 400 to rotate, a load and unload station 312, and a robot 314 configured to transport wafers between stations 312 and 308. Furthermore, apparatus 300 may include one or more rinse washing stations 316 to rinse and/or wash a surface of a wafer before or after a polishing process and one or more pad conditioners 318. Although illustrated with three polishing stations, apparatus 300 may include any desired number of polishing stations and one or more of such polishing stations may be used to buff a surface of a wafer as described herein. Furthermore, apparatus 300 may include an integrated wafer clean and dry system similar to system 104 described above.

Wafer transfer station 308 is generally configured to stage wafers before or between polishing processes and to load and unload wafers from wafer carriers described below. In addition, station 308 may be configured to perform additional functions such as washing the wafers and/or maintaining the wafers in a wet environment.

Carousel apparatus 400 includes polishing heads 402, 404, 406, and 408, each configured to hold a single wafer. In accordance with one embodiment of the invention, three of carriers 402–408 are configured to retain and urge the wafer against a polishing surface (e.g., a polishing surface associated with one of stations 302–306) and one of carriers 402–408 is configured to transfer a wafer between a polishing station and stage 308. Each carrier 402–408 is suitably spaced from post 310, such that each carrier aligns with a polishing station or station 308. In accordance with one embodiment of the invention, each carrier 402–408 is attached to a rotatable drive mechanism using a gimbal system (not illustrated), which allows carriers 402–408 to cause a wafer to rotate (e.g., during a polishing process). In addition, the carriers may be attached to a carrier motor assembly that is configured to cause the carriers to translate—e.g., along tracks 410. In accordance with one aspect of this embodiment, each carrier 402–408 rotates and translates independently of the other carriers.

In operation, wafers are processed using apparatus 300 and 400 by loading a wafer onto station 308, from station 312, using robot 314. When a desired number of wafers are loaded onto the carriers, at least one of the wafers is placed in contact with a polishing surface. The wafer may be positioned by lowering a carrier to place the wafer surface in contact with the polishing surface or a portion of the carrier (e.g., a wafer holding surface) may be lowered, to position the wafer in contact with the polishing surface. After polishing is complete, one or more conditioners—e.g., conditioner 318, may be employed to condition the polishing surfaces.

Figure 5:
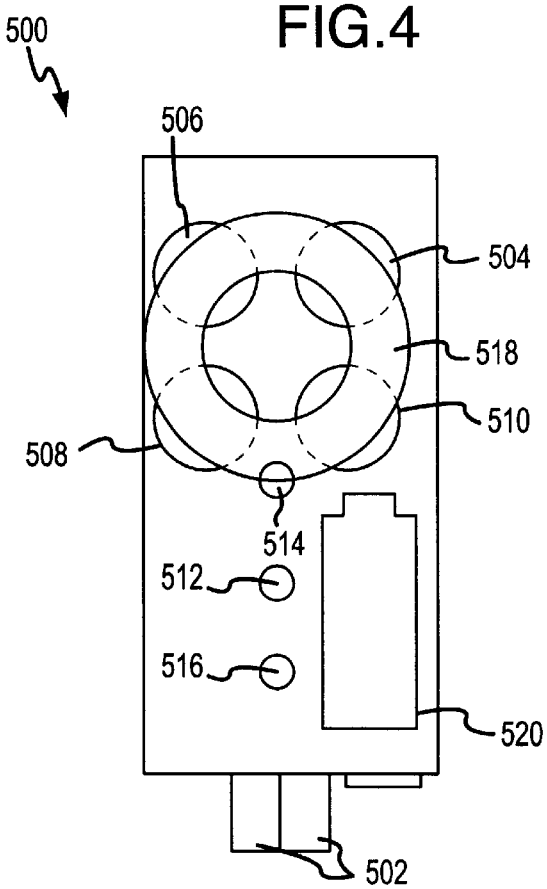
FIG. 5 illustrates a top cut-away view of a polishing system in accordance with yet another embodiment of the invention.

FIG. 5 illustrates another polishing system 500 in accordance with the present invention. System 500 is suitably configured to receive a wafer from a cassette 502 and return the wafer to the same or to a predetermined different location within a cassette in a clean, dry state.

System 500 includes polishing stations 504 and 506, a buff station 508, a head loading station 510, a transfer station 512, a wet robot 514, a dry robot 516, a rotatable index table 518, and a clean station 520.

Figure 6:
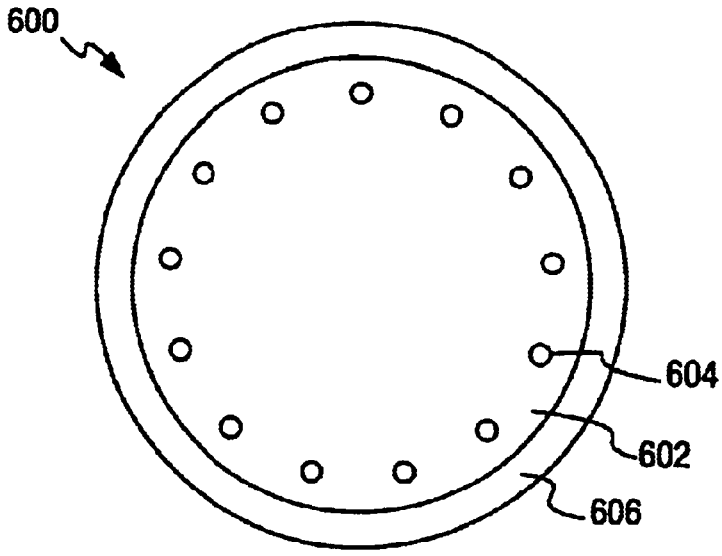
FIG. 6 illustrates a bottom view of a carrier for use with the system of FIG. 5.

During a polishing process, a wafer is held in place by a carrier 600, illustrate in FIG. 6. Carrier 600 includes a receiving plate 602, including one or more apertures 604, and a retaining ring 606. Apertures 604 are designed to assist retention of a wafer by carrier 600 by, for example, allowing a vacuum pressure to be applied to a back side of the wafer or by creating enough surface tension to retain the wafer. Retaining ring limits the movement of the wafer during the polishing process.

In operation, dry robot 516 unloads a wafer from a cassette 502 and places the wafer on transfer station 512. Wet robot 514 retrieves the wafer from station 512 and places the wafer on loading station 510. The wafer then travels to polishing stations 504–508 for polishing and returns to station 510 for unloading by robot 514 to station 512. The wafer is then transferred to clean system 520 to clean, rinse, and dry the wafer before the wafer is returned to load and unload station 502 using dry robot 516.

Figure 7:
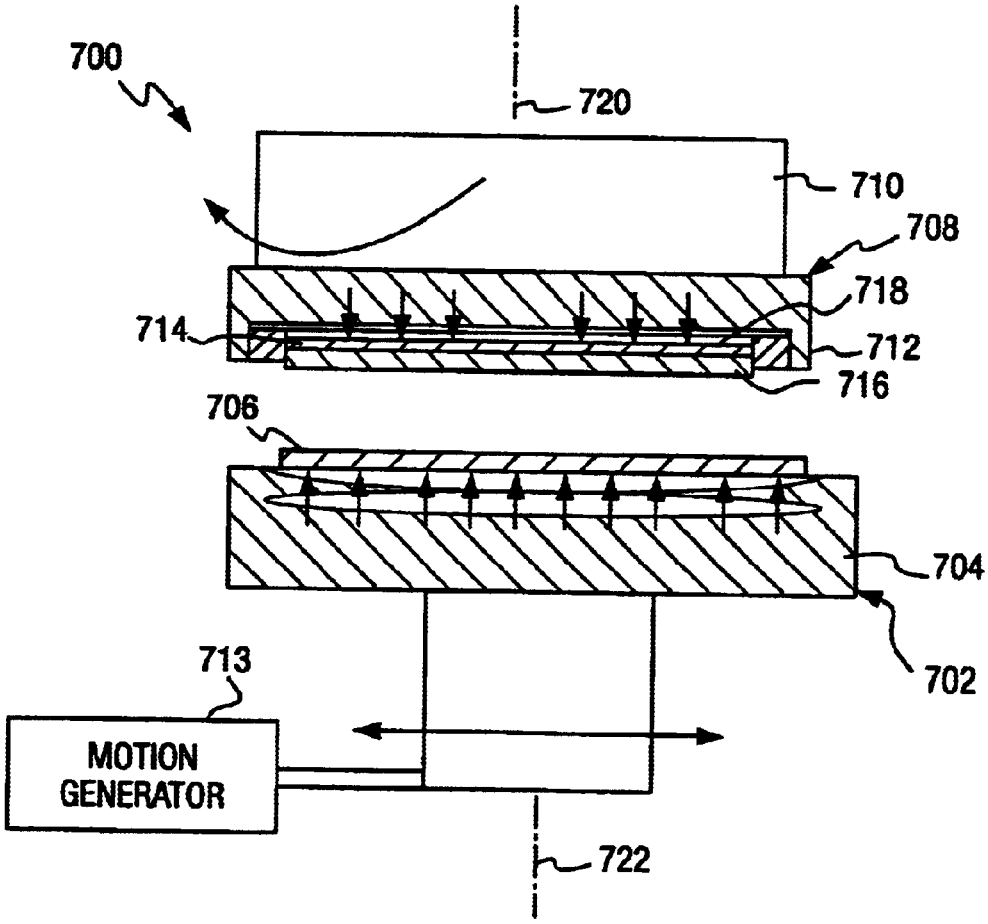
FIG. 7 illustrates a cross-sectional view of a polishing apparatus in accordance with one embodiment of the invention.
Figure 11:
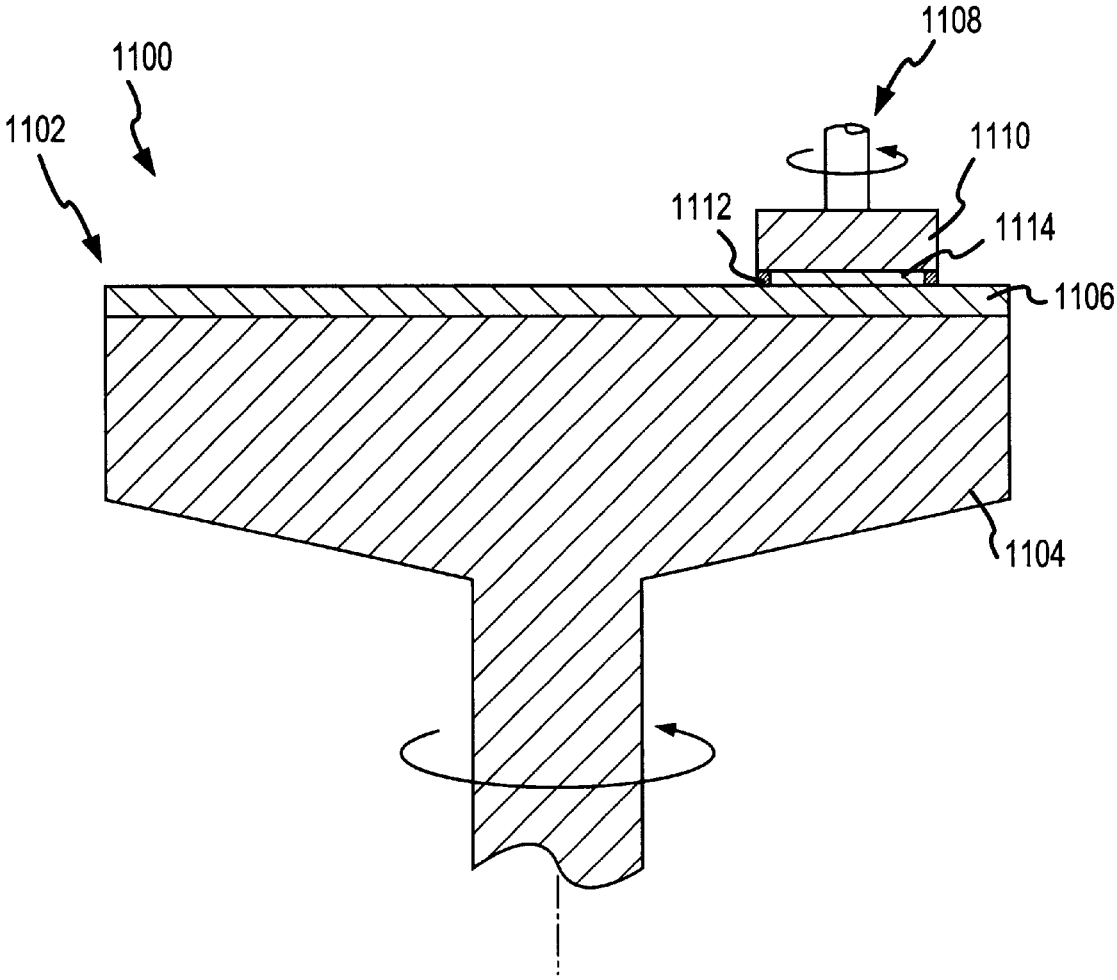
FIG. 11 illustrates a top cut-away view of a polishing apparatus in accordance with another embodiment of the invention.

FIGS. 7, and 11 illustrate apparatus suitable for polishing stations (e.g., polishing stations 108–114, 302–306, and 504–508) in accordance with the present invention. In accordance with various embodiments of the invention, systems such as apparatus 100, 300, and 500 may include one or more of the polishing apparatus described below, and if the system includes more than one polishing station, the system may include any combination of polishing apparatus, including at least one polishing apparatus described herein.

FIG. 7 illustrates a cross-sectional view of a polishing apparatus 700 suitable for polishing a surface of a wafer in accordance with an exemplary embodiment of the invention. Apparatus 700 includes a lower polish module 702, including a platen 704 and a polishing surface 706 and an upper polish module 708, including a body 710 and a retaining ring 712, which retains the wafer during polishing.

Upper polish module or carrier 708 is generally configured to receive a wafer for polishing and urge the wafer against the polishing surface during a polishing process. In accordance with one embodiment of the invention, carrier 708 is configured to receive a wafer, apply a vacuum force (e.g., about 55 to about 70 cm Hg at sea level) to the backside of wafer 716 to retain the wafer, move in the direction of the polishing surface to place the wafer in contact with polishing surface 706, release the vacuum, and apply a force (e.g., about 0 to about 8 psi.) in the direction of the polishing surface. In addition, carrier 708 is configured to cause the wafer to move. For example, carrier 708 may be configured to cause the wafer to move in a rotational, orbital, or translational direction. In accordance with one aspect of this embodiment, carrier 708 is configured to rotate at about 2 rpm to about 20 rpm about an axis 720.

Carrier 708 also includes a resilient film 714 interposed between a wafer 716 and body 710 to provide a cushion for wafer 716 during a polishing process. Carrier 708 may also include an air bladder 718 configured to provide a desired, controllable pressure to a backside of the wafer during a polishing process. In this case, the bladder may be divided into plenums or zones such that various amounts of pressure may be independently applied to each zone.

Lower polishing module 702 is generally configured to cause the polishing surface to move by means of motion generator 713. By way of example, lower modules 702 may be configured to cause the polishing surface to rotate, translate, orbit, or any combination thereof In accordance with one embodiment of the invention, lower module 702 is configured such that platens 704 orbits with a radius of about 0.25 to about 1 inch, about an axis 722 at about 30 to about 340 orbits per minute, while simultaneously causing the platen 704 to dither or partially rotate. In this case, material is removed primarily from the orbital motion of module 704. Causing the polishing surface to move in an orbital direction is advantageous because it allows a relatively constant speed between the wafer surface and the polishing surface to be maintained during a polishing process. Thus material removal rates are relatively constant across the wafer surface.

Polishing apparatus including orbiting lower modules 702 are additionally advantageous because they require relatively little space compared to rotational polishing modules described below. In particular, because a relatively constant velocity between the wafer surface and the polishing surface can be maintained across the wafer surface by moving the polishing surface in an orbital motion, the polishing surface can be about the same size as the surface to be polished. For example, a diameter of the polishing surface may be about 0.5 inches greater than the diameter of the wafer.

Figure 8:
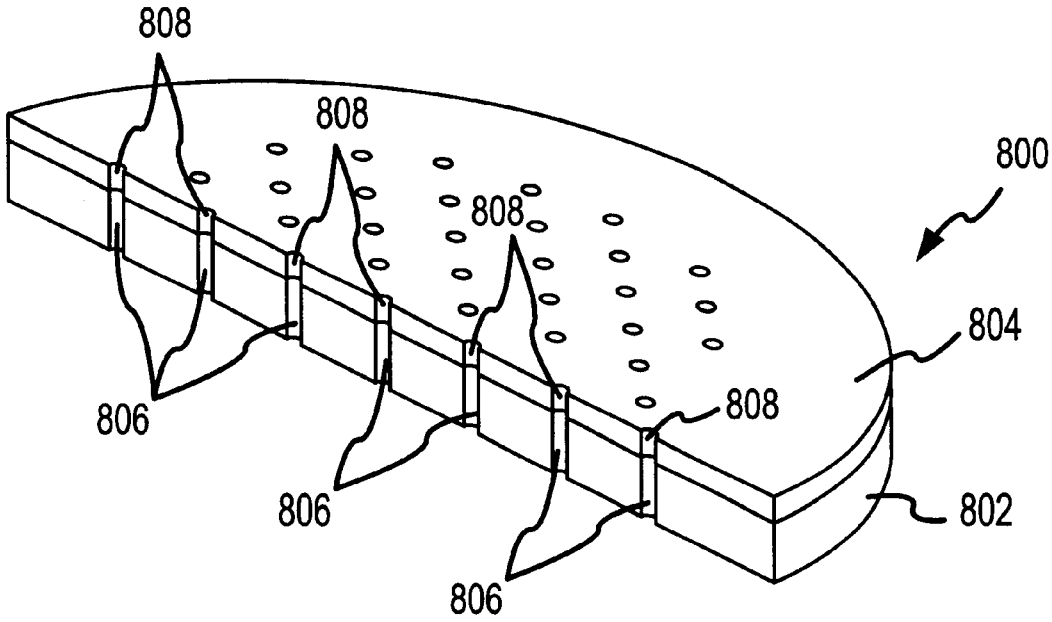
FIG. 8 illustrates a portion of the polishing apparatus of FIG. 7 in greater detail.

FIG. 8 illustrates a portion of a lower polishing module 800, including a platen 802 and a polishing surface 804, suitable for use with polishing apparatus 700. Platen 802 and polishing surface 804 include conduits 806 and 808 formed therein to allow polishing fluid such as slurry to flow through platen 802 and surface 804 toward a surface of the wafer during the polishing process. Flowing slurry toward the surface of the wafer during the polishing process is advantageous because the slurry acts as a lubricant and thus reduces friction between the wafer surface and polishing surface 804. In addition, providing slurry through the platen 802 and toward the wafer facilitates uniform distribution of the slurry across the surface of the wafer, which in turn facilitates uniform material removal from the wafer surface. The slurry flow rates may be selected for a particular application; however, in accordance with one embodiment of the invention, the slurry flow rates are less than about 200 ml/minute and preferably about 120 ml/minute.

Figure 9A:
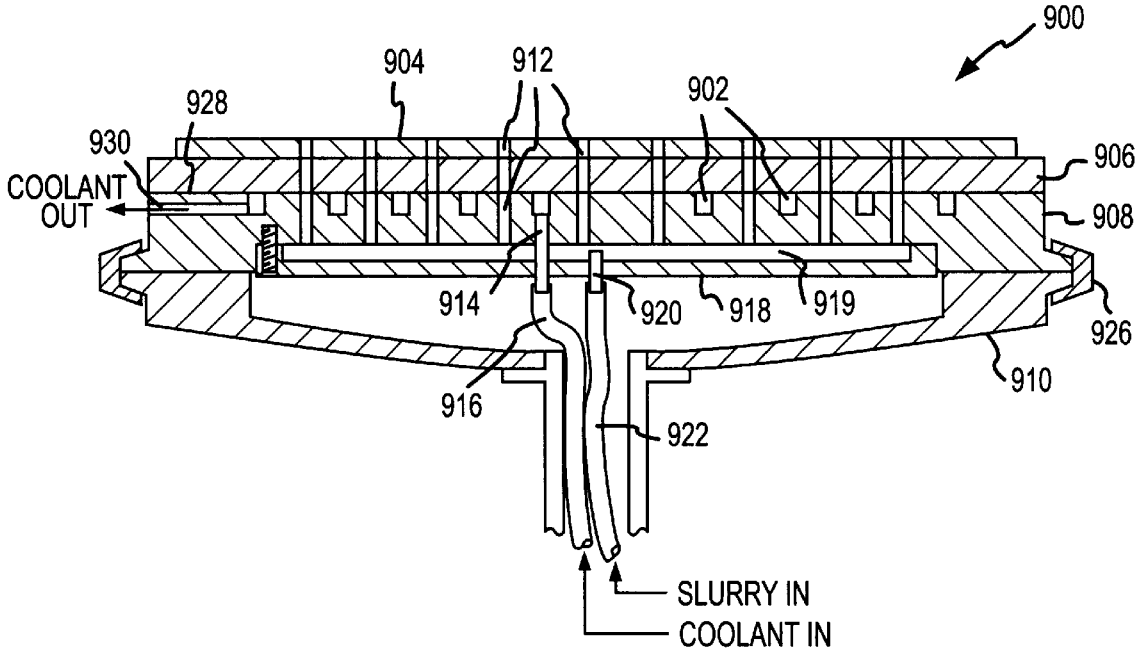
FIGS. 9A and 9B illustrate a platen including heat exchange channels in accordance with the present invention.
Figure 9B:
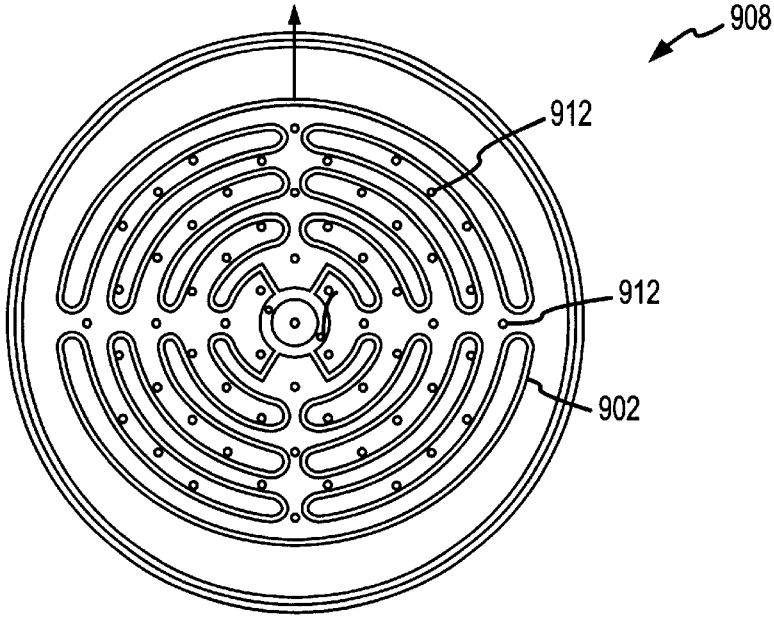

FIGS. 9A and 9B illustrate a portion of a lower polish module 900 in accordance with yet another embodiment of the invention. Structure or polish head 900 includes a fluid channel 902 to allow heat exchange fluid such as ethylene glycol and/or water to flow therethrough to cool a surface of a polishing surface 904 such as a polishing pad. Module 900 is suitably formed of material having a high thermal conduction coefficient to facilitate control of the processing temperature.

Lower polish head 900 includes a top plate 906, channel plate 908, manifold 919, and a bottom plate 910, which are coupled together to form polish head 900. Top plate 906 includes a substantially planar top surface to which a polishing surface 904 such as a polishing pad is attached—e.g., using a suitable adhesive. Channel section 908 includes channel 902 to allow heat exchange fluid to flow through a portion of polish head 900. The manifold 919 is designed to distribute slurry through conduits 912 from a slurry delivery tube 922 as more fully explained below. Bottom plate 910 is configured for attachment of the polish head 900 to a shaft. To allow slurry distribution through polish head 900, top plate 906, and channel section 908 each include corresponding conduits 912 (similar to channels 806 and 808, illustrated in FIG. 8), through which a polishing solution or slurry may flow. In accordance with one exemplary embodiment of the invention, top plate 906 is brazed to channel section 908 and the combination of top plate 906 and channel plate 908 is coupled to bottom plate 910 using clamp ring 926, or alternatively another suitable attachment mechanism such as bolts.

Heat exchange fluid is delivered to polish head 900 through a fluid delivery conduit 914 and a flexible fluid delivery tube 916. Fluid circulates through channel 902 and exits at outlet 930.

In an alternative embodiment, the channel groove is formed in the underside of the cover plate. The channel groove may be sealed by attaching a circular disk having a planar top surface to the underside of the cover plate. The bottom section is attached to the circular disk, or, alternatively, the junction of the circular disk and the bottom section could be combined. In either this case or the illustrated case, a channel groove through which a heat exchange fluid can be circulated is formed beneath the substantially planar surface of the platen assembly.

In accordance with yet another embodiment of the invention, the temperature of the polishing process may be controlled by providing a heat exchange fluid to the backside of a wafer. Apparatus for exposing a heat exchange fluid to the backside of a wafer are well known in the art. For an example of an apparatus configured to regulate the polishing rate of a wafer by backside heat exchange, see U.S. Pat. No. 5,605,488, issued to Ohashi et al. on Feb. 25, 1997, which patent is hereby incorporated by reference.

Fluid, typically slurry or deionized water, may be distributed to lower polish head 900 using a flexible slurry delivery tube 922 and a slurry delivery conduit 920 to deliver the fluid to a manifold 919. Fluid is then distributed to a top surface of polish head 900 using conduits 912 through the top plate 906 and channel section 908. The top plate 906 and channel section 908 may be considered the same as a platen 802 as shown in FIG. 8. The platen 802 supports the polishing surface 804 and has a plurality of conduits 806 for allowing a fluid to pass through the conduits 806 in the platen 802 and, preferably, through corresponding conduits 808 in the polishing surface 804. This allows the fluid to reach the working area of the polishing surface 804. The platen 802 may comprise several layers (906 and 908 in FIG. 9) for performing additional functions not directly related to the distribution of fluids to the polishing surface 804.

Figure 12:
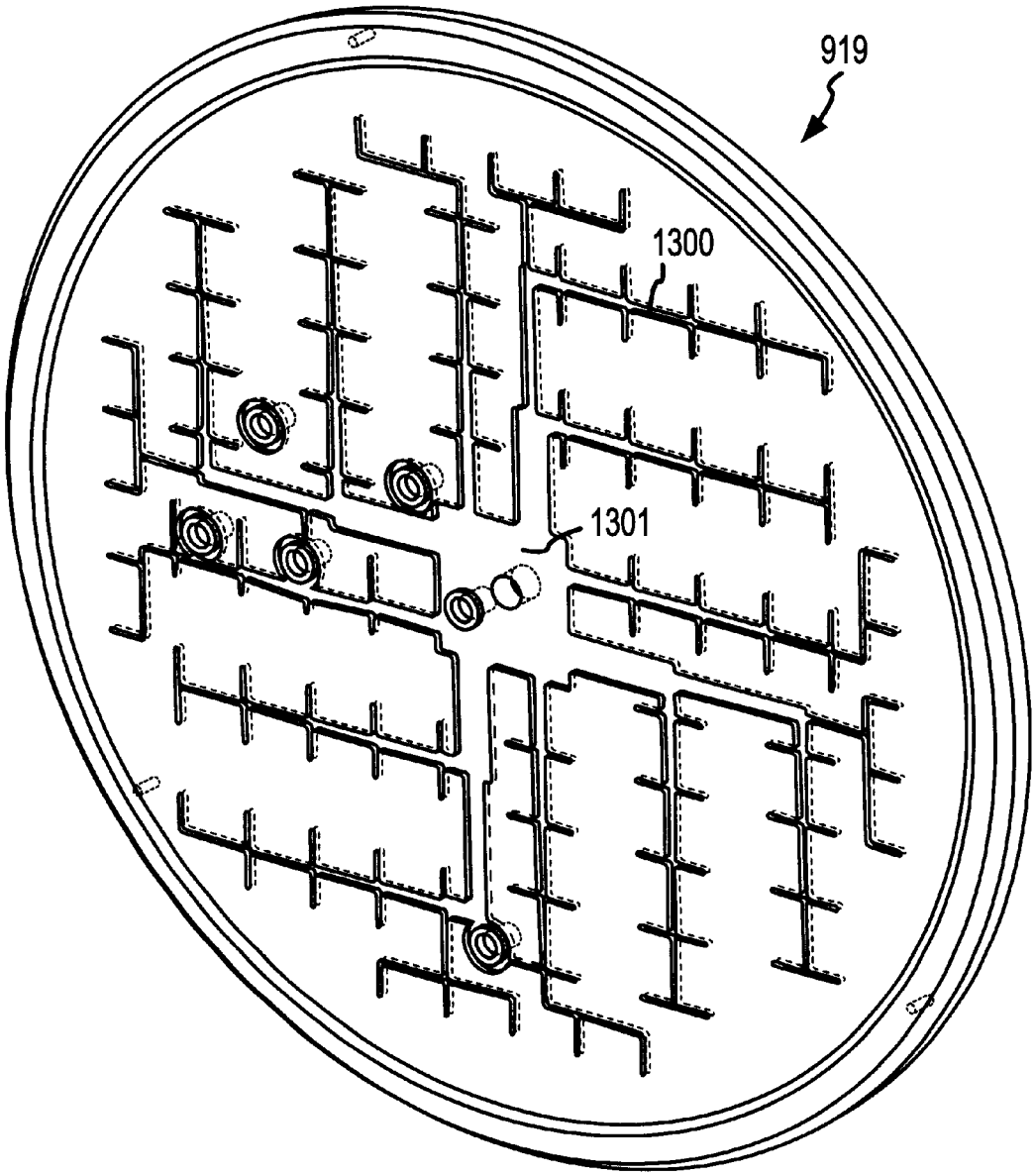
FIG. 12 illustrates a perspective view of a manifold.

Referring to FIGS. 9*a* and 12, the manifold 919 controls the fluid distribution to the conduits 912 that allow the fluid to pass through the platen 906, 908 and the polishing surface 904. The manifold 919 uses a plurality of channels 1300 in controlling the fluid distribution to the conduits 912 of the platen 906, 908. The channels 1300 may be formed by removing material from a monolithic manifold 919. For example, the channels 1300 may be formed by machining or etching the channels into the manifold 919.

Figure 13:
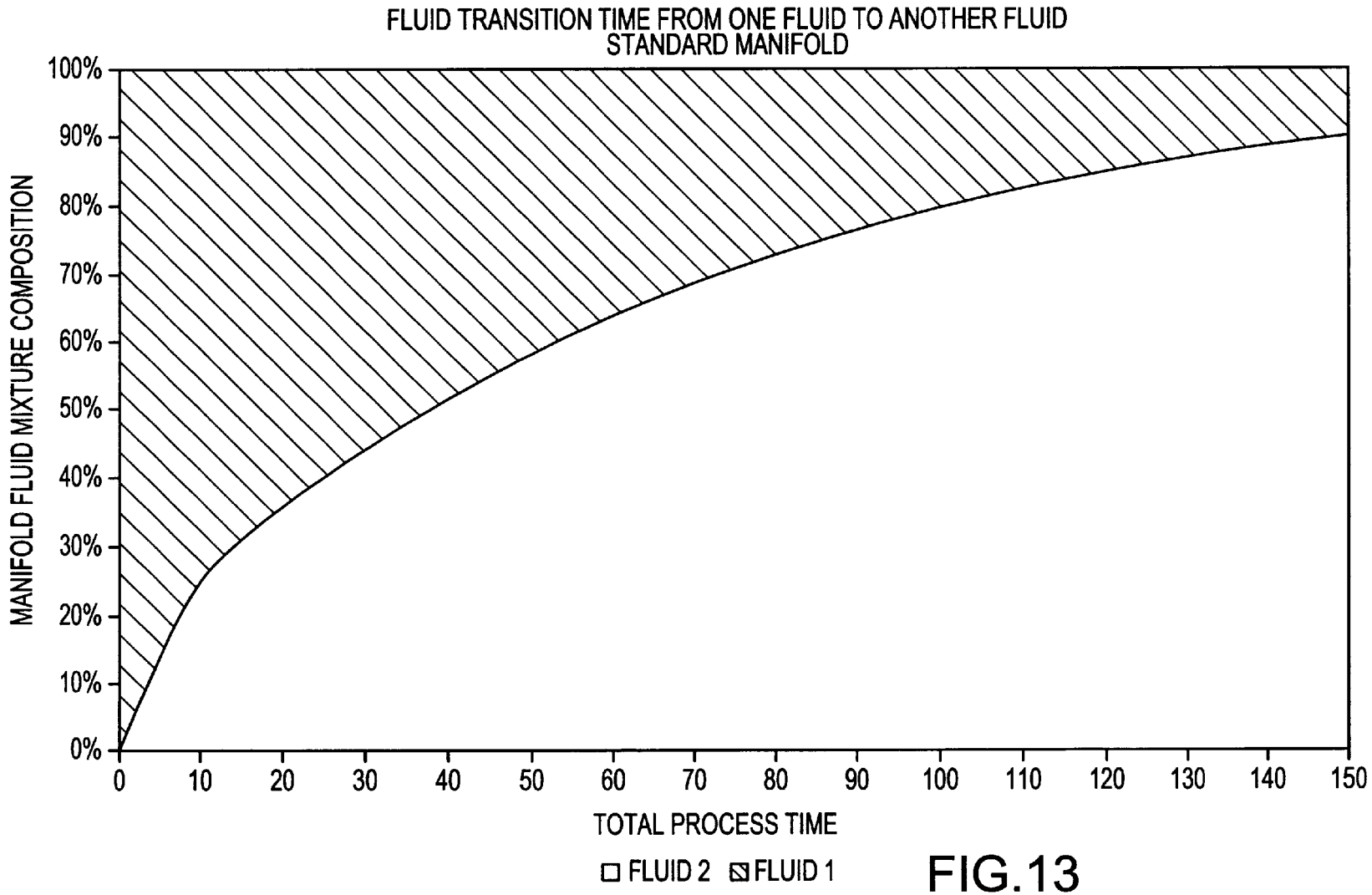
FIG. 13 illustrates a fluid transition time for a prior art fluid distribution apparatus.
Figure 14:
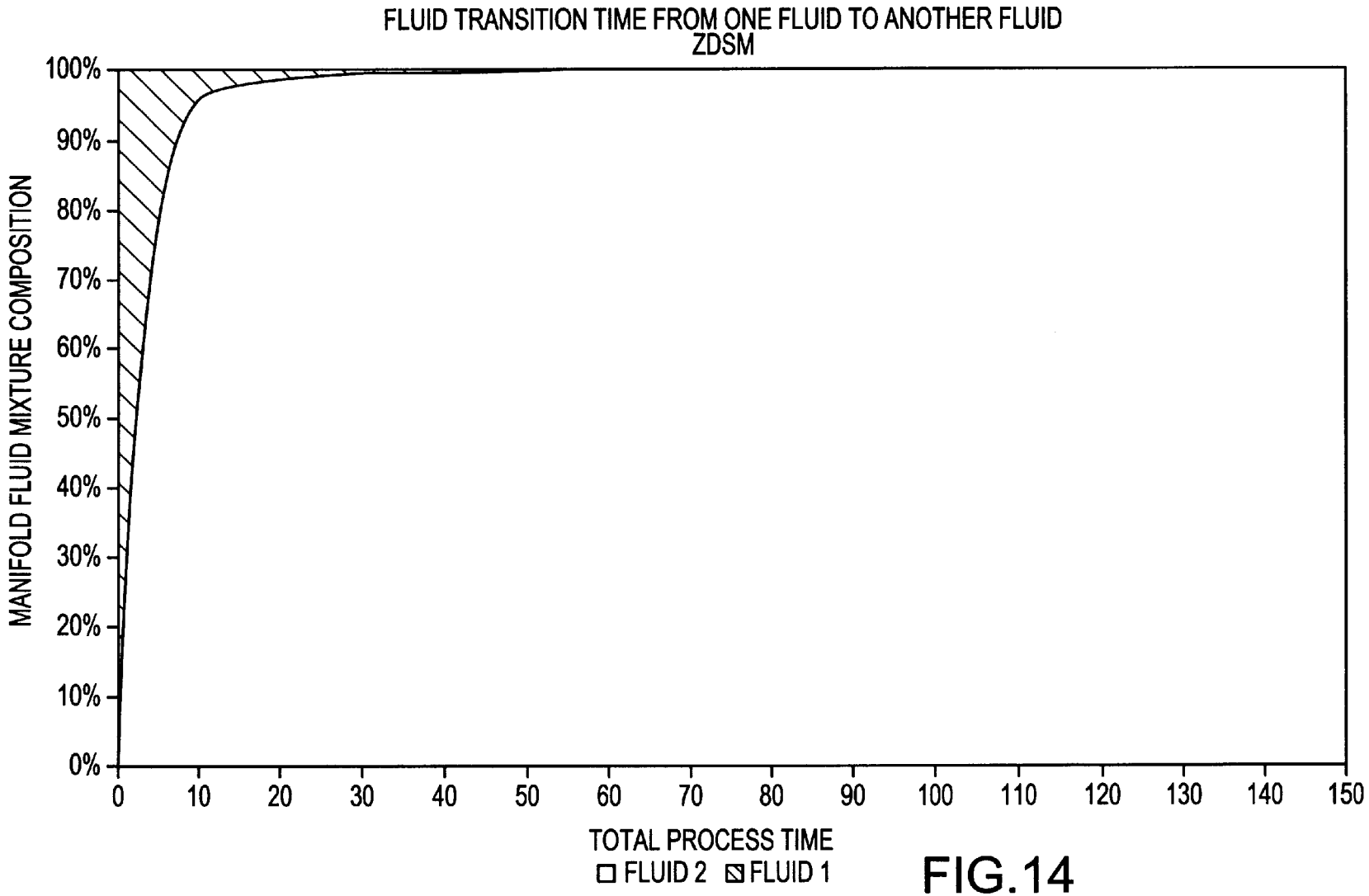
FIG. 14 illustrates a fluid transition time for a manifold according to this invention.

The volume of the channels is preferably substantially reduced from the volume of the channels in the prior art. As an example for one embodiment of the invention, less than a third, and most preferably less than a tenth, of the top surface area of the manifold 919 is covered by the channels 1300. Reducing the width and volume of the channels 1300 reduces the time for a fluid change over. In addition, the channels 1300 have a laminar flow compared to the turbulent flow of the prior art, which also assists in reducing the time for a fluid change over. Reducing the fluid change over time improves process flexibility in changing fluids during the planarization process. FIG. 13 illustrates the results from an experiment for a fluid transition time from one fluid to another fluid using a prior art fluid distribution method. FIG. 14 illustrates the great reduction in fluid transition time from one fluid to anther fluid using the manifold 919 of the invention.

In another embodiment of the invention the channel cross-sectional area at substantially every point in the channels 1300 is greater than, preferably between 1.1 and 10 times, the combined cross-sectional area of all the conduits 912 being serviced by the channel 1300. In another embodiment the cross-sectional area for channels 1300 leading to a subgroup of the plurality of conduits 912 is about 1.5 times the cross-sectional area of the combined conduits 912 in the subgroup and the channels 1300 leading to a single conduit 912 are about 2 times the cross-sectional area of the single conduit. The channels 1300 leading to a single conduit 912 are made slightly larger to allow for easier machining of the channels 1300 and to allow particles in the fluid to more easily pass through the channels 1300. Thus, there is a progressive reduction in channel 1300 cross-sectional area as a channel 1300 feeds fewer and fewer conduits 912.

The channels 1300 have larger cross sections than the conduits 912 causing the conduits 912 in the platen 906, 908 to be the most restrictive feature in the fluid flow path. The progressive reduction in channel 1300 size and restrictive conduits 912 assist in producing a more uniform backpressure in the manifold 919. The uniform backpressure results in a more uniform velocity of fluid flow through the channels 1300 and to the surface of the polishing surface 904. The substantially uniform fluid velocity throughout the channels 1300 reduce the effect of any motions imparted on the manifold 919. It should be noted that an equivalent result may be obtained by controlling the cross-sectional area of the conduits in the polishing surface 904 while making the cross-sectional area of the conduits 912 in the platen 906, 908 larger than the cross-sectional area of the conduits 912 in the polishing surface 904. This would result in the conduits 912 in the polishing surface 904 being the most restrictive feature in the fluid flow path.

The slurry delivery conduit 920 communicates fluid from a fluid source (not shown) to the channels 1300 in the manifold 919. The slurry delivery conduit 920 is preferably in fluid communication with a central area 1301 of the manifold 919 that feeds the plurality of channels 1300. The slurry delivery conduit 920 may be in fluid communication with a plurality of fluid sources so that a plurality of different fluids, preferably one at a time, may be communicated to the channels 1300 as desired.

The manifold 919 may be used in combination with platens that are stationary or that move in a variety of directions. For example, the manifold 919 may be easily used to control the fluid distribution with platens that are rotated or orbited.

Figure 15:
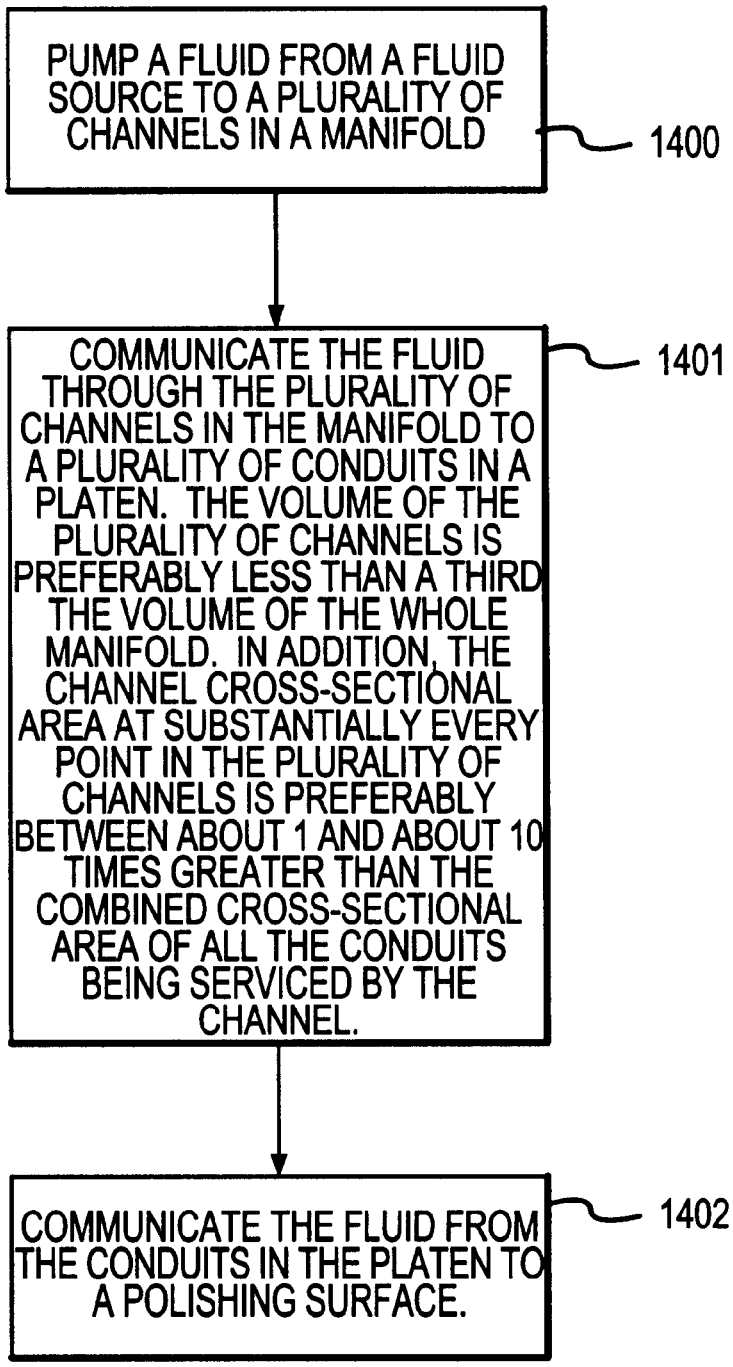
FIG. 15 illustrates a flowchart for practicing the invention.

With reference to FIGS. 9*a*, 12, and 15, in operation, a fluid may be distributed across a polishing surface 904 by pumping a fluid from a fluid source to a central area 1301 connected to a plurality of channels 1300 in a manifold 919. (Step 1400) The fluid is communicated through the plurality of channels 1300 in the manifold 919 to a plurality of conduits 912 in a platen 906, 908. (Step 1401) The fluid travels through the conduits 912 in the platen 906, 908 and through the polishing surface 904, preferably through corresponding conduits 912 in the polishing surface 904, to reach a working area of the polishing surface 904. (Step 1402)

The slurry distribution manifold 919 and method of using the slurry distribution manifold 919 produce several advantages over the prior art. The manifold 919 greatly improves the uniformity of slurry delivery to the polishing surface 904, even under various motions, thereby decreasing wafer non-uniformity. The lower non-uniformity leads to improved die yields. A common problem in the prior art is that additional slurry must be used to insure that all areas of the polishing surface 904 have sufficient slurry. Less slurry may be used by improved control over the slurry distribution resulting in a lower cost of ownership.

Another advantage of the manifold 919 is that greater flexibility in tuning the slurry may be achieved. The channels may be designed to produce uniform slurry delivery or the channels may be designed to direct additional slurry to areas that will benefit the particular polishing process. The slurry delivery may be tuned by plugging holes in the manifold 919 (or platen or polishing surface) or by replacing the manifold 919 with another manifold that has channels that produce the desired slurry distribution. The replacement of one manifold 919 with another manifold is a simple process that requires no other changes to the hardware and allows for easy control over the slurry distribution. A further advantage is that the manifold 919 adds additional rigidity in supporting the polishing surface 904 by replacing the cavity in the prior art with a preferably rigid manifold 919.

Figure 10:
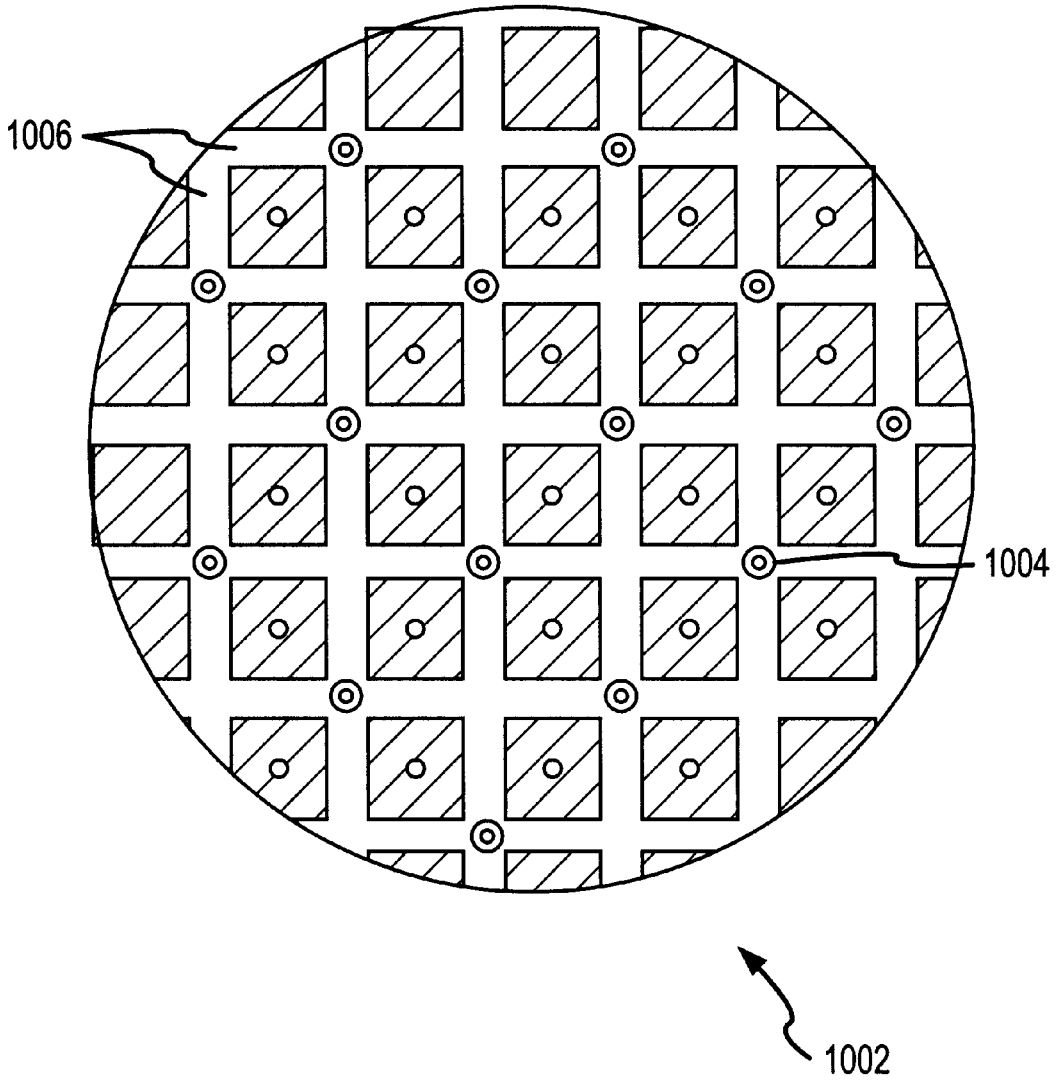
FIG. 10 illustrates a top plan view of a polishing surface, having grooves and apertures, in accordance with the present invention.

FIG. 10 illustrates a top view of polishing surface 1002 in accordance with the present invention. Polishing surface 1002 includes conduits or apertures 1004 extending through surface 1002. Apertures 1004 are suitably aligned with conduits formed within a platen (e.g., platen 802), such that polishing solution may circulate through the platen and polishing surface 1002 as described above in connection with FIGS. 8, 9A, and 9B. Surface 1000 may also include grooves 1006. Grooves 1006 are configured to effect transportation of the polishing solution on polishing surface 1002 during a polishing process. Polishing surface 1002 may also be porous, further facilitating transportation of the polishing solution. It will be appreciated that polishing surface 1002 may have any suitably-shaped openings that are configured to produce a uniform or other desired slurry distribution across the surface. For example, grooves 1006 may be configured to facilitate a hydroplaning action such that a wafer floats on polishing solution during a polishing process. In accordance with one exemplary embodiment of the invention, surface 1002 is formed of polyurethane, having a thickness of about 0.050 to about 0.080 inches, and grooves 1006 are formed using a gang saw, such that the grooves are about 0.015 to about 0.045 inches deep, with a pitch of about 0.2 inches and a width of about 0.15 to about 0.30 inches.

FIG. 11 illustrates a cross-sectional view of a polishing apparatus 1100 suitable for polishing a surface of a wafer in accordance with another exemplary embodiment of the invention. Apparatus 1100 includes a lower polish module 1102, including a platen 1104 and a polishing surface 1106 and an upper polish module 1108, including a body 1110 and a retaining ring 1112, which retains the wafer during polishing. Apparatus 1100 may also include a slurry distribution apparatus to supply a polishing fluid to a top surface of lower module 1102.

Upper module 1108 is configured to cause the wafer to rotate, orbit, translate, or a combination thereof and to retain the wafer. In addition, upper module 1108 is configured to apply a pressure to wafer 1114 in the direction of lower module 1102, as discussed above in reference to upper module 708. Lower module is generally configured to move a polishing surface by rotating platen 1104 about its axis.

Although apparatus 1100 may be used to polish wafers in accordance with the present invention, apparatus 1100 generally requires additional space compared to apparatus 700. In particular, the diameter of polishing surface 1106 is generally about twice the diameter of wafer 1114, whereas polishing surface 706 of lower module 702 is about the same size as the wafer. Additionally, because lower platen 1100 rotates about an axis, delivery of a polishing solution through platen 1104 may be problematic. Thus, several of the advantages associated with through-platen slurry delivery may be difficult to achieve using a rotational platen system, as illustrated in FIG. 11.

In operation, a wafer 1114 surface is polished by moving wafer 1114 using upper module 1108, while simultaneously rotating lower polishing module 1102 and polishing surface 1106 attached thereto. In accordance with one exemplary embodiment of the invention, upper module moves wafer 1114 in both a rotational and a translational direction during the polishing process. In accordance with another embodiment, upper module 1108 orbits about an axis.

Although the present invention is set forth herein in the context of the appended drawing figures, it should be appreciated that the invention is not limited to the specific form shown. Various other modifications, variations, and enhancements in the design and arrangement of the chemical mechanical polishing methods and apparatus as set forth herein may be made without departing from the spirit and scope of the present invention as set forth in the appended claims.

What is claimed is:

1. An apparatus for planarizing a front surface of a wafer comprising:

a) a platen for supporting a polishing surface, said platen having a plurality of conduits adapted for communicating a fluid to said front surface;

b) a motion generator for causing relative motion between said wafer and the polishing surface;

c) a manifold having a plurality of channels for delivering the fluid to the conduits of the platen, said manifold positioned beneath the platen wherein at least one of said plurality of channels has a progressively reduced cross-section; and d) a slurry delivery conduit adapted for communicating the fluid from a fluid source to the manifold.

2. The apparatus of claim 1 wherein the motion generator orbits the polishing surface.

3. The apparatus of claim 1 wherein the motion generator rotates the polishing surface.

4. The apparatus of claim 1 wherein the channels cover less than a third of the surface area of the manifold.

5. The apparatus of claim 1 wherein the channel cross-sectional area at substantially every point in the plurality of channels is between about 1 and 10 times greater than the combined cross-sectional area of all the conduits being serviced by the channel.

6. An apparatus according to claim 1 wherein the cross-sectional area of each channel is greater than the combined cross-sectional area of all the conduits being serviced by the channel.

7. An apparatus according to claim 1 wherein the cross-sectional area of channels leading to a subgroup of the plurality of conduits is about 1.5 times the cross-sectional area of the combined conduits in the subgroup and the cross-sectional area of the channels leading to a single conduit is about 2 times the cross-sectional area of the single conduit.

8. An apparatus for planarizing a front surface of a wafer comprising:

a) a platen for supporting a polishing surface, said platen having a plurality of conduits adapted for communicating a fluid to said front surface;

b) a motion generator for causing relative motion between said wafer and the polishing surface;

c) a carousel apparatus for transporting the wafer to the polishing surface;

d) a manifold having a plurality of channels for delivering the fluid to the conduits of the platen, said manifold positioned beneath the platen wherein at least one plurality of channels has a progressively reduced cross-section; and e) a slurry delivery conduit adapted for communicating the fluid from a fluid source to the manifold.

9. The apparatus of claim 8 wherein the motion generator orbits the polishing surface.

10. The apparatus of claim 8 wherein the motion generator rotates the polishing surface.

11. The apparatus of claim 8 wherein the channels cover less than a third of the surface area of the manifold.

12. The apparatus of claim 8 wherein the channel cross-sectional area at substantially every point in the plurality of channels is between about 1 and 10 times greater than the combined cross-sectional area of all the conduits being serviced by the channel.

13. An apparatus for planarizing a front surface of a wafer comprising:

a) a platen for supporting a polishing surface;

b) a carrier configured to urge said wafer against the polishing surface, said carrier configured to rotate and including a flexible membrane having a front surface for supporting the wafer and a plurality of plenums for exerting different pressures against different areas on a back surface of the membrane;

c) a motion generator for causing relative motion between the wafer and the polishing surface; and d) a manifold positioned beneath the platen, wherein the manifold has a plurality of channels for distributing a fluid to the polishing surface.

14. The apparatus of claim 13 further comprising:

e) a clean system for cleaning the wafer.

15. The apparatus of claim 13 further comprising:

e) a polishing surface conditioner.

16. The apparatus of claim 13 wherein the motion generator is configured to orbit the platen.

* * * * *